US008513510B1

(12) United States Patent
Huang

(10) Patent No.: US 8,513,510 B1
(45) Date of Patent: Aug. 20, 2013

(54) MARCHING DRUM ASSEMBLY

(76) Inventor: Ming-Fang Huang, Taichung (TW)

( * ) Notice: Subject to any disclaimer, the term of this patent is extended or adjusted under 35 U.S.C. 154(b) by 0 days.

(21) Appl. No.: 13/423,525

(22) Filed: Mar. 19, 2012

(51) Int. Cl.
*G10D 13/02* (2006.01)

(52) U.S. Cl.
USPC ..... 84/421

(58) Field of Classification Search
USPC ..... 84/421
See application file for complete search history.

(56) References Cited

U.S. PATENT DOCUMENTS 6,329,583 B1 * 12/2001 May ..... 84/421
6,403,869 B2 * 6/2002 May ..... 84/421
6,770,805 B2 * 8/2004 May ..... 84/421
7,265,287 B2 * 9/2007 Shimada ..... 84/421
7,394,008 B2 * 7/2008 May ..... 84/421
7,420,110 B2 * 9/2008 May ..... 84/421
RE42,487 E * 6/2011 May ..... 84/421

* cited by examiner

*Primary Examiner* — David Warren
*Assistant Examiner* — Robert W Horn
(74) *Attorney, Agent, or Firm* — Muncy, Geissler, Olds & Lowe, PLLC

(57) ABSTRACT

A marching drum assembly of the present invention includes a supporter, at least an engaging element, at least a drum body, and a carrier. The engaging element includes a first and a second clipper boards which are parallel to each other, and a clipper trough is formed therebetween to receive a board-shape frame of the supporter. The engaging element also has a positioning element which is able to pivot relatively to the second clipper board. The positioning element is able to be fixed to the first clipper board after being pivoted toward the first clipper board. Thus, the two clipper boards are clamped tightly. Besides, one of the clipper boards connects with the drum body, and the carrier is capable of bearing the supporter. Thereby, the drum can be positioned at any preferred position on the frame, and easy adjustment and fixation can be achieved.

14 Claims, 5 Drawing Sheets

MARCHING DRUM ASSEMBLY

BACKGROUND OF THE INVENTION

1. Field of the Invention

The present invention relates to a marching drum assembly, more specifically to a marching drum assembly which provides an easy adjustment of drum.

2. Description of the Prior Art

A conventional marching drum assembly includes a carrier, a supporter, and a plurality of drums. The carrier connects with the supporter, and the drums are fixed to the supporter respectively. The carrier can be positioned on a shoulder, and then the drums can be carried by a user. Thereby, the user can beat the drums when walking.

More specifically, the supporter is usually annular, and the drums are disposed surrounding the supporter spacedly. Drums are usually fixed to a conventional supporter by screwing, as disclosed in U.S. Pat. No. 7,265,287 and U.S. Pat. No. 6,403,869. However, the threaded holes on the supporter are formed at predetermined positions, so positional adjustment cannot be achieved. For example, the drums are different in size and weight, but positional adjustment of the drums for a preferred gravity center is impossible on a conventional marching drum assembly. On the other hand, the positions of the drums can not be adjusted to fit the body shape of a user.

The present invention is, therefore, arisen to obviate or at least mitigate the above mentioned disadvantages.

SUMMARY OF THE INVENTION

The main object of the present invention is to provide a marching drum assembly which enables the drum to be adjusted and fixed more easily.

To achieve the above and other objects, a marching drum assembly of the present invention includes a supporter, at least an engaging element, at least a drum body, and a carrier.

The supporter has a board-shape frame, wherein a thickness of the frame is smaller than a width of the frame. The drum is positioned on the frame by the engaging element. The carrier has a shouldering portion and a loading portion. The shouldering portion is provided to be positioned on a shoulder, and the loading portion connects with the supporter.

The engaging element includes a first clipper board and a second clipper board which are parallel to each other, and a clipper trough is formed between the first and the second clipper board to receive the frame. The first clipper board has a first end and an opposite second end, and the second clipper board has a third end and an opposite fourth end. The first end of the first clipper board connects with the third end of the second clipper board. More preferably, the first end of the first clipper board and the third end of the second clipper are formed integrally. The second end of the first clipper board corresponds to the fourth end of the second clipper board positionally. A first slot is formed at the second end of the first clipper board, and a corresponding second slot is formed at the fourth end of the second clipper board. A positioning element is disposed pivotably at the second slot and includes a pivot member, a threaded rod, and a rotating portion. An axle rod is disposed on the second slot, and the pivot member is disposed on the axle rod rotatably. The pivot member and the threaded rod are formed integrally, and the rotating portion forms a threaded hole to screw with the threaded rod. Besides, at least part of the rotating portion has a larger external diameter than an internal diameter of the first slot.

The positioning element is able to pivot between a first position and a second position. When the positioning element is at the first position, the threaded rod is located in the first slot, and a longitudinal direction of the threaded rod is perpendicular to the two clipper boards. The rotating portion moves toward the pivot member when the rotating portion is rotated toward a specific direction, and then the rotating portion abuts against a terminal end of the first slot to clamp and to position the two clipper boards and the frame received in the clipper trough. When the positioning element is at the second position, the threaded rod leaves the first slot, and the longitudinal direction is parallel with the two clipper board. Thus, the frame received in the clipper trough is able to be removed from the clipper board.

Thereby, the drum body can be positioned at any preferred position on the frame using the engaging element. In respect to positional adjustment of the drum body, a user can loosen the engaging element slightly in order to move the drum body to a preferred position, and the drum body can be positioned again by the engaging element fastening.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
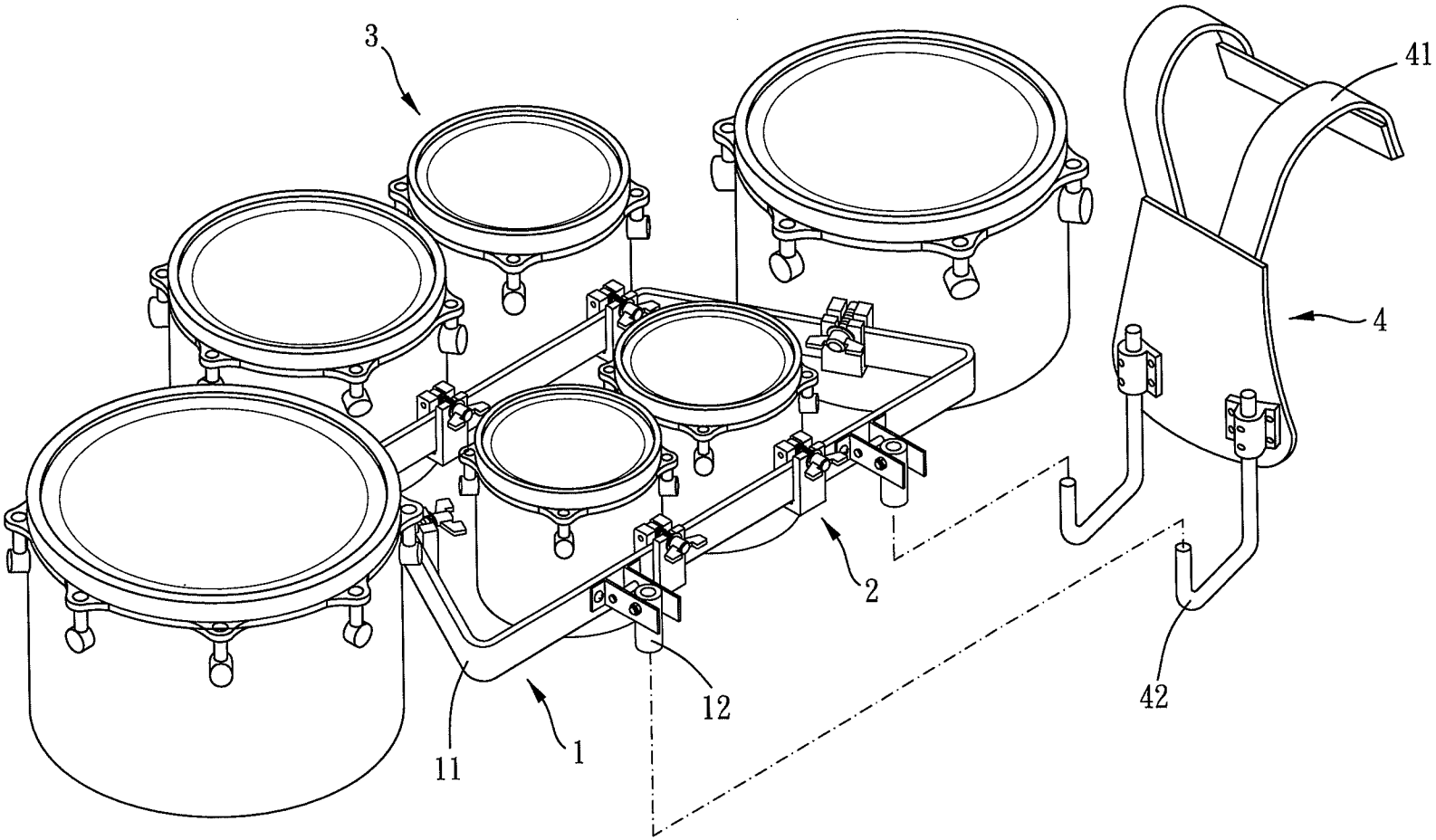
FIG. 1 is a stereogram drawing showing a marching drum assembly of the present invention.
Figure 2:
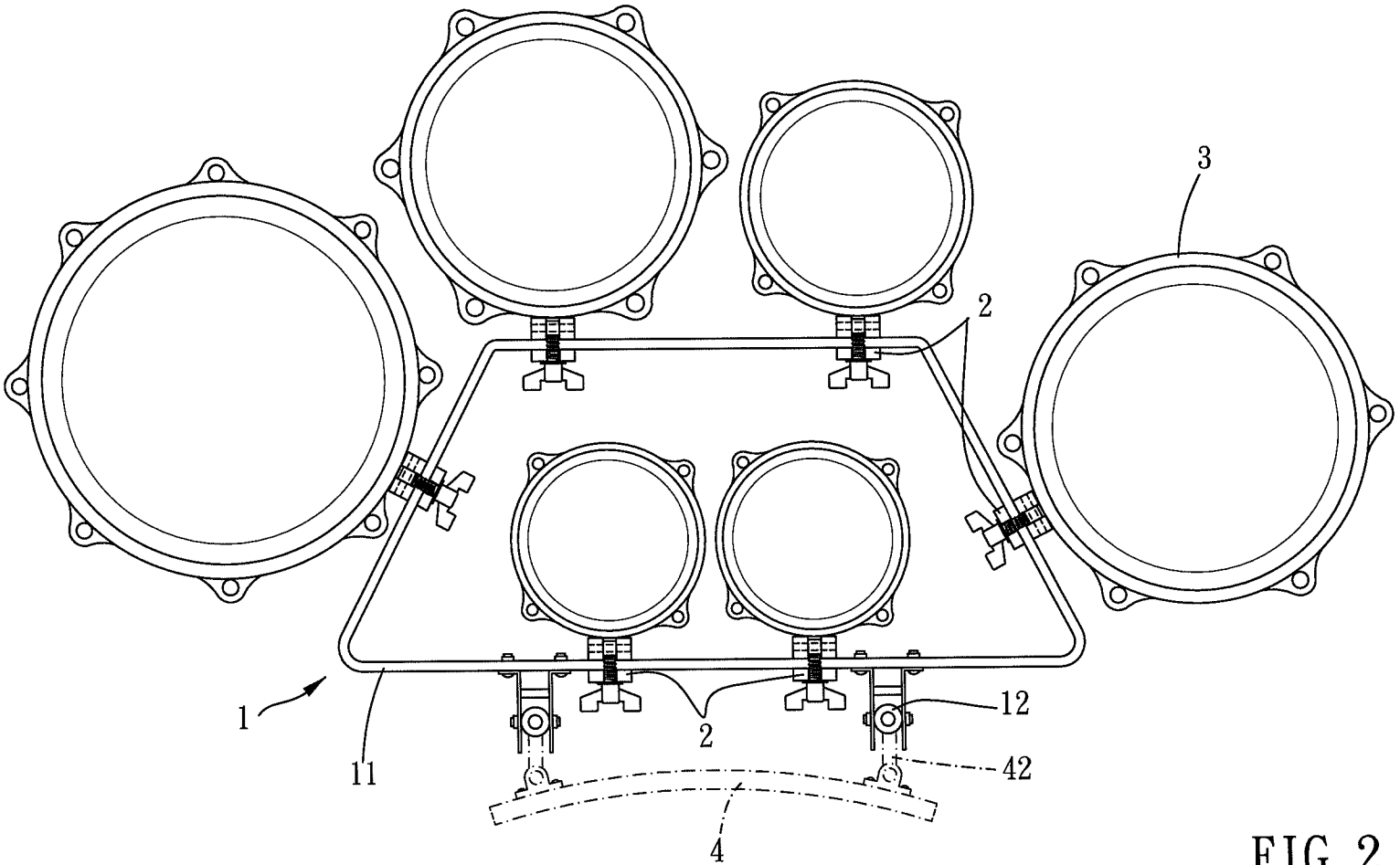
FIG. 2 is a top plan view showing a marching drum assembly of the present invention.

Please refer to FIG. 1 and FIG. 2, the marching drum assembly of the present invention includes a supporter 1, at least an engaging element 2, at least a drum body 3, and a carrier 4.

The supporter 1 has a board-shape frame 11, wherein a thickness of the frame 11 is smaller than a width of the frame 11. In the major embodiment of the present invention, the frame 11 is substantially an annular trapezoid.

The carrier 4 has a shouldering portion 41 and a loading portion 42. The shouldering portion 41 is provided to be positioned on a shoulder, and the loading portion 42 connects with a connecting portion 12 of the supporter 4. Structure of the carrier 4 is similar with conventional carriers, so topics about that will not be discussed further here.

Figure 3:
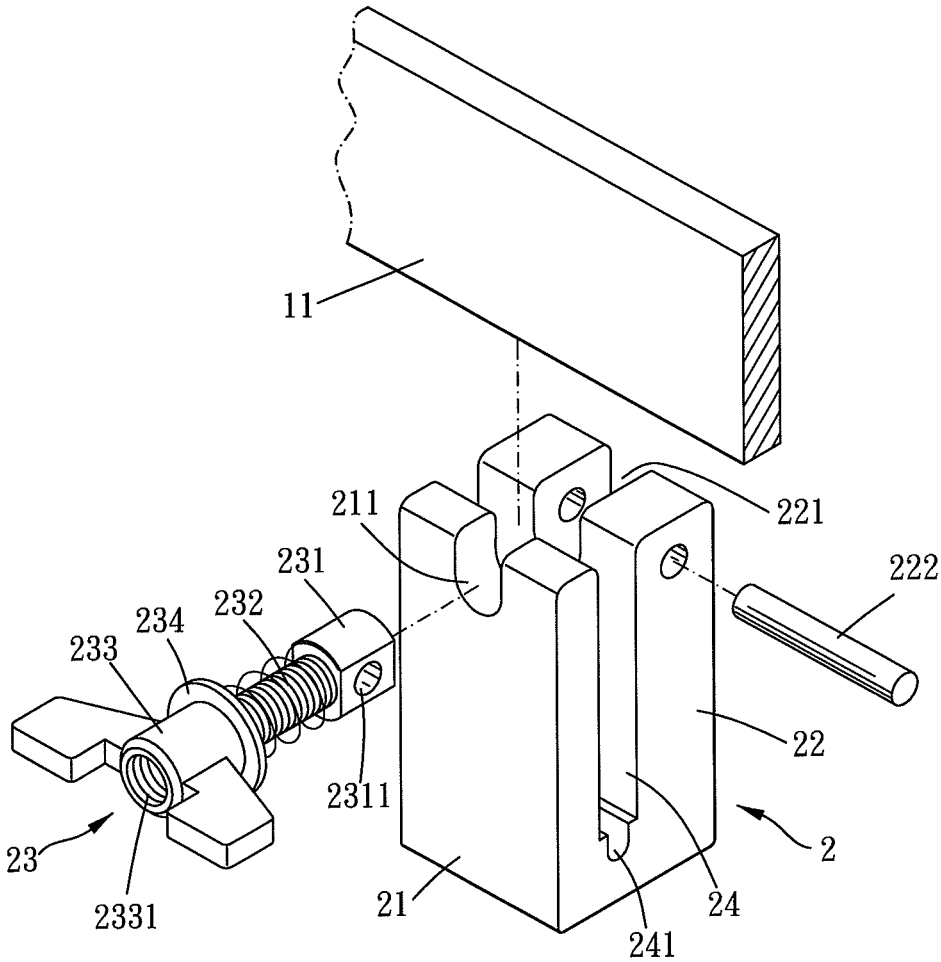
FIG. 3 is a partial breakdown view showing a marching drum assembly of the present invention.
Figure 4:
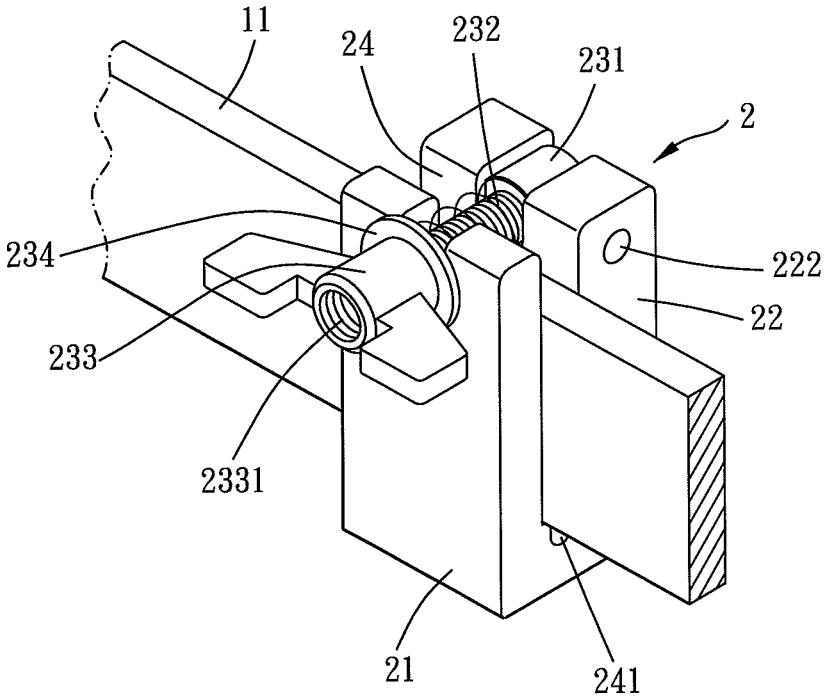
FIG. 4 is a partial illustration showing a marching drum assembly of the present invention.
Figure 5:
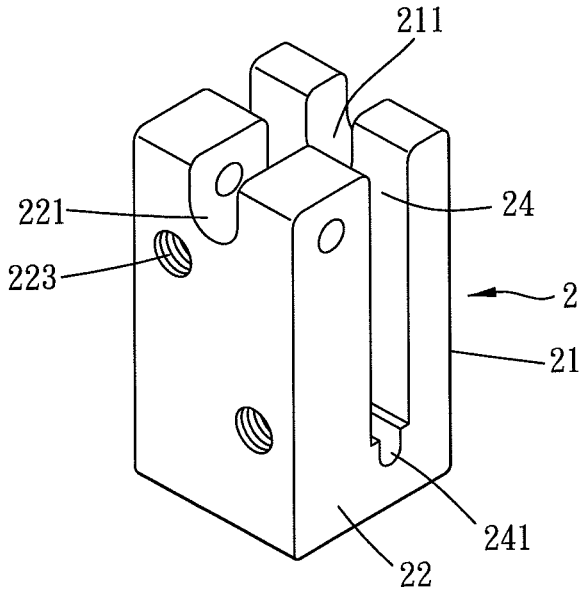
FIG. 5 is a partial illustration showing a marching drum assembly of the present invention.

Please refer to FIG. 3 to FIG. 5, the engaging element 2 includes a first clipper board 21 and a second clipper board 22 which are parallel to each other. A clipper trough 24 is formed between the first and the second clipper boards 21,22 to receive the frame 11, and a width direction of the frame 11 is parallel to a depth direction of the clipper trough 24. The first clipper board 21 has a first end and an opposite second end, and the second clipper board 22 has a third end and an opposite fourth end. The first end of the first clipper board 21 connects with the third end of the second clipper board 22, and the second end of the first clipper board 21 corresponds to the fourth end of the second clipper board 22 positionally. In the major embodiment of the present invention, the first end of the first clipper board 21 and the third end of the second clipper board 22 are formed integrally, and a bottom of the clipper trough 24 forms a shallow trench 241 extending along a longitudinal direction of the bottom of the clipper trough 24 to provide elasticity to the clipper trough 24. Besides, a first slot 211 is formed at the second end of the first clipper board 21, and a positionally corresponding second slot 221 is formed at the fourth end of the second clipper board 22. An axle rod 222 is disposed fixedly on the second slot 221.

A positioning element 23 is disposed at the fourth end of the second clipper board 22. More particularly, the positioning element 23 includes a pivot member 231, a threaded rod 232, and a rotating portion 233. The pivot member 231 connects with the fourth end of the second clipper board 22 pivotably. More preferably, the pivot member 231 is sleeved onto the axle rod 222 via a pivot hole 2311. At least part of the rotating potion 233 has a larger external diameter than an internal diameter of the first slot 211 to keep the rotating portion 233 from entering the first slot 211. An end of the threaded rod 232 connects fixedly with one of the pivot member 231 or the rotating portion 233, and the other one of the pivot member 231 or the rotating portion 233 forms a threaded hole to screw with the other end of the threaded rod 232. In the major embodiment of the present invention, the pivot member 231 and the threaded rod 232 are formed integrally, and the threaded hole 2331 is formed on the rotating portion 233. Besides, a gasket 234 is sleeved onto the threaded rod 232.

The positioning element 23 is able to pivot between a first position and a second position. When the positioning element 23 is at the first position, the threaded rod 232 is located in the first slot 211, and a longitudinal direction of the threaded rod 232 is perpendicular to the two clipper boards 21,22. At this time, the gasket 234 is located between the rotating portion 233 and the first slot 211. The rotating portion 233 moves toward the pivot member 231 when the rotating portion 233 is rotated toward a specific direction by a user, and then the rotating portion 233 abuts against a terminal end of the first slot 211 to clamp and to position the two clipper boards 21,22 and the frame 11 received in the clipper trough 24. On the contrary, when the positioning element 23 is at the second position, the threaded rod 232 leaves the first slot 211, and the longitudinal direction of the threaded rod 232 is parallel with the two clipper boards 21,22. Thus, the frame 11 received in the clipper trough 24 is able to be removed from the clipper trough 24.

The engaging element 2 also has a fixing portion to be engaged with the drum body. In the major embodiment of the present invention, the fixing portion 223 includes two threaded holes formed on a face which is opposite to the clipper trough of one of the two clipper board, as shown in FIG. 5. The fixing portion 223 is fixed to the drum body by a threaded bolt.

Figure 6:
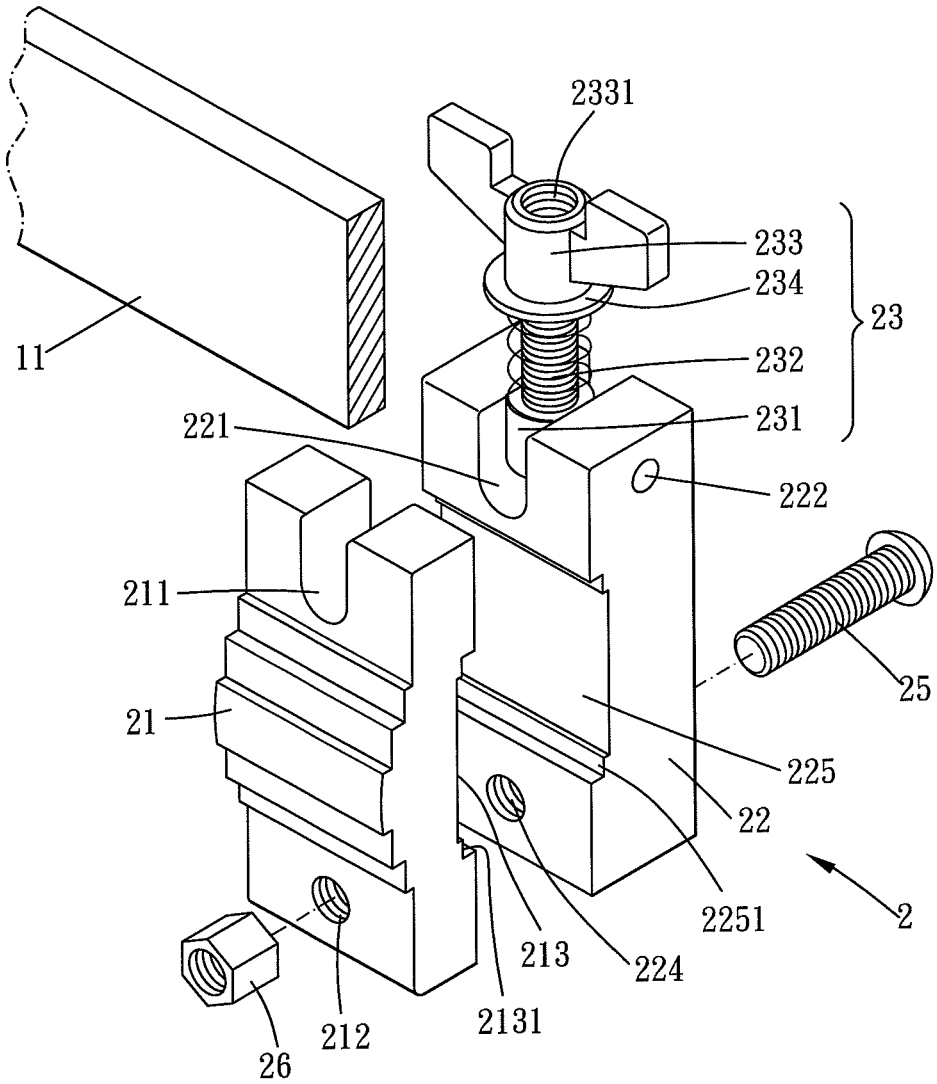
FIG. 6 is a partial breakdown view showing a second embodiment of a marching drum assembly of the present invention.

Pleased refer to FIG. 6, in other possible embodiment of the present invention, the first and the second clipper boards 21,22 are formed independently. The first end of the first clipper board 21 and the third end of the second clipper board 22 form a fixing threaded hole 212,224, and the two fixing threaded holes 212,224 corresponds to each other positionally. A bolt 25 is screwed with the two fixing threaded holes 212,224, and a nut is screwed with a terminal end of the bolt 25 to clamp the two clipper boards 21,22. Besides, part of each clipper board 21,22 forms a recess face 213,225 which faces the clipper trough 24. Each recess face 213,225 extends perpendicularly to a depth of the clipper trough 24. Each of edges of two opposite sides of each recess face 213,225 forms a ladder fringe 2131,2251. Each ladder fringe 2131,2251 extends along an extending direction of each recess face 213,225. A width of each recess face 213,225 or a distance between the two opposite ladder fringe 2131,2251 of each recess face 213,225 is equal to the width of the frame 11. Thereby, the ladder fringes 2131,2251 enable frames in different widths to be sandwiched and positioned between the two recess faces 213,225.

In practice, referring to FIG. 1 to FIG. 4, structures mentioned above can provide easy adjustment for the position of the drum body. First, the two clipper boards 21,22 are loosened by rotating the rotating portion 233 toward a specific direction. And then, the frame 11 can be removed from the clipper trough 24 after the positioning element 23 being pivoted to the second position. As such, the engaging element 2 is able to be moved to a preferred position on the frame 11. After the movement of the engaging element 2 is finished, the two clipper boards 21,22 and the frame 11 can be clamped and positioned by pivoting the positioning element 23 to the first position and rotating the rotating portion 233 toward the other direction. Moreover, the engaging element 2 can be moved to a preferred position on the frame 11 even by loosening the positioning element 23 slightly only.

In conclusion, the marching drum assembly of the present invention has a plurality of advantages:

1. The drum body can be positioned at any preferred position on the frame of the supporter.
2. Adjustment during walking is possible. More specifically, the positioning element only has to be loosened slightly for moving along the frame. Detachment of the drum body is not necessary anymore.
3. Adjustment is simple and easy. Tools for detaching the drum body are not needed.
4. The engaging element can fit not only to the frame without threaded hole of the present invention but also to conventional frames with threaded holes. Thus, the engaging element is more flexible in use.

What is claimed is:

1. A marching drum assembly, including:

a supporter, having a board-shape frame, wherein a thickness of the frame is smaller than a width of the frame;

at least an engaging element, including a first clipper board and a second clipper board which are parallel to each other, a clipper trough being formed between the first and the second clipper boards to receive the frame of the supporter, the first clipper board having a first end and an opposite second end, the second clipper board having a third end and an opposite fourth end, the first end of the first clipper board connecting with the third end of the second clipper board, the second end of the first clipper board corresponding to the fourth end of the second clipper board positionally, a first slot being formed at the second end of the first clipper board, a positioning element being disposed at the fourth end of the second clipper board and including a pivot member, a threaded rod, and a rotating portion, the pivot member connecting with the fourth end of the second clipper board pivotably, at least part of the rotating portion having a larger external diameter than an internal diameter of the first slot, an end of the threaded rod connecting fixedly with one of the pivot member or the rotating portion, the other one of the pivot member or the rotating portion forming a threaded hole to screw with the other end of the threaded rod, the positioning element is capable of pivoting between a first position and a second position;

at least a drum body, the drum body connecting with one of the first clipper board or the second clipper board;

wherein when the positioning element is at the first position, the threaded rod is located in the first slot, a longitudinal direction of the threaded rod is perpendicular to the first and the second clipper boards, the rotating portion moves toward the pivot member when the rotating portion is rotated toward a specific direction, the rotating portion then abuts against a terminal end of the first slot to clamp and to position the first and the second clipper boards and the frame received in the clipper trough;

wherein when the positioning element is at the second position, the threaded rod leaves the first slot, the longitudinal direction of the threaded rod is parallel with the first and the second clipper boards, the frame received in the clipper trough is able to be removed from the clipper trough.

2. The marching drum assembly of claim 1, wherein the first end of the first clipper board and the third end of the second clipper board are formed integrally.

3. The marching drum assembly of claim 2, wherein a bottom of the clipper trough forms a shallow trench which extends along a longitudinal direction of the bottom of the clipper trough to provide elasticity to the clipper trough.

4. The marching drum assembly of claim 1, wherein the first and the second clipper boards are formed independently, each of the first end of the first clipper board and the third end of the second clipper board forms a fixing threaded hole, the two fixing threaded hole of the first and the second clipper boards are screwed with a bolt, a nut is screwed with a terminal end of the bolt to clamp the first and the second clipper boards firmly.

5. The marching drum assembly of claim 4, wherein part of each clipper board forms a recess face which faces the clipper trough, an extending direction of each recess face is perpendicular to a depth of the clipper trough, each of edges of two opposite sides of each recess face forms a ladder fringe, each ladder fringe extends along the extending direction of each recess face.

6. The marching drum assembly of claim 1, wherein a second slot corresponding to the first slot is formed at the fourth end of the second clipper board, an axle rod is disposed on the second slot, the pivot member is disposed on the axle rod rotatably, the pivot member and the threaded rod are formed integrally, the threaded hole is formed on the rotating portion.

7. The marching drum assembly of claim 2, wherein a second slot corresponding to the first slot is formed at the fourth end of the second clipper board, an axle rod is disposed on the second slot, the pivot member is disposed on the axle rod rotatably, the pivot member and the threaded rod are formed integrally, the threaded hole is formed on the rotating portion.

8. The marching drum assembly of claim 4, wherein a second slot corresponding to the first slot is formed at the fourth end of the second clipper board, an axle rod is disposed on the second slot, the pivot member is disposed on the axle rod rotatably, the pivot member and the threaded rod are formed integrally, the threaded hole is formed on the rotating portion.

9. The marching drum assembly of claim 1, wherein a gasket is sleeved onto the threaded rod, the gasket is located between the rotating portion and the first slot when the positioning element is at the first position.

10. The marching drum assembly of claim 2, wherein a gasket is sleeved onto the threaded rod, the gasket is located between the rotating portion and the first slot when the positioning element is at the first position.

11. The marching drum assembly of claim 4, wherein a gasket is sleeved onto the threaded rod, the gasket is located between the rotating portion and the first slot when the positioning element is at the first position.

12. The marching drum assembly of claim 1, further including a carrier, the carrier having a shouldering portion and a loading portion, the shouldering portion is provided to be positioned on a shoulder, the loading portion connecting with the supporter.

13. The marching drum assembly of claim 2, further including a carrier, the carrier having a shouldering portion and a loading portion, the shouldering portion is provided to be positioned on a shoulder, the loading portion connecting with the supporter.

14. The marching drum assembly of claim 4, further including a carrier, the carrier having a shouldering portion and a loading portion, the shouldering portion is provided to be positioned on a shoulder, the loading portion connecting with the supporter.

* * * * *